United States Patent [19]

Lamberty et al.

[11] Patent Number: 4,939,527

[45] Date of Patent: Jul. 3, 1990

[54] DISTRIBUTION NETWORK FOR PHASED ARRAY ANTENNAS

[75] Inventors: Bernard J. Lamberty, Kent; Edward J. Vertatschitsch, Bothell; George W. Fitzsimmons, Kent, all of Wash.

[73] Assignee: The Boeing Company, Seattle, Wash.

[21] Appl. No.: 299,458

[22] Filed: Jan. 23, 1989

[51] Int. Cl.[5] ..... H01Q 3/30

[52] U.S. Cl. ..... 343/771; 343/754; 343/778

[58] Field of Search ..... 343/771, 777, 778, 754

[56] References Cited

U.S. PATENT DOCUMENTS

| | | | |
|---|---|---|---|
| 3,576,579 | 4/1971 | Appelbaum et al. | 343/778 |
| 3,701,162 | 10/1972 | Seaton | 343/771 |
| 4,185,286 | 1/1980 | Drabowitch et al. | 343/771 |
| 4,303,923 | 12/1981 | Bitter, Jr. et al. | 343/771 |
| 4,356,497 | 10/1982 | Dudóme | 343/771 |
| 4,554,551 | 11/1985 | Frazita | 343/771 |

OTHER PUBLICATIONS

"A Flat-Feed Technique for Phased Arrays", Appelbaum et al., IEEE Transactions on Antennas and Propogation, vol. AP-20, No. 5, Sep. 1972.

*Primary Examiner*—Rolf Hille
*Assistant Examiner*—Doris J. Johnson
*Attorney, Agent, or Firm*—Indyk, Pojunas & Brady

[57] ABSTRACT

A distribution network for a modified space-fed phased array antenna consists of a planar array of radiating slots distributed along a coplanar wall in each of an ensemble of parallel waveguides. This waveguide ensemble is fed or excited by an orthogonal waveguide or waveguides, through a row of slots in a wall common to the excitation waveguides and the parallel waveguide ensemble, one slot per waveguide. A predetermined amplitude distribution is achieved in the plane parallel to the axis of the exciting waveguide by adjusting the coupling value of each exciting slot, and in the orthogonal plane by adjusting the displacement of the radiating slots from the center line of the waveguides, and by adjusting slot width, length, and geometry. Such an array of slots is used to feed the inside face of a quasi-space-fed antenna array having identical, individual electronics modules.

12 Claims, 11 Drawing Sheets

FIG. 6A
PRIOR ART
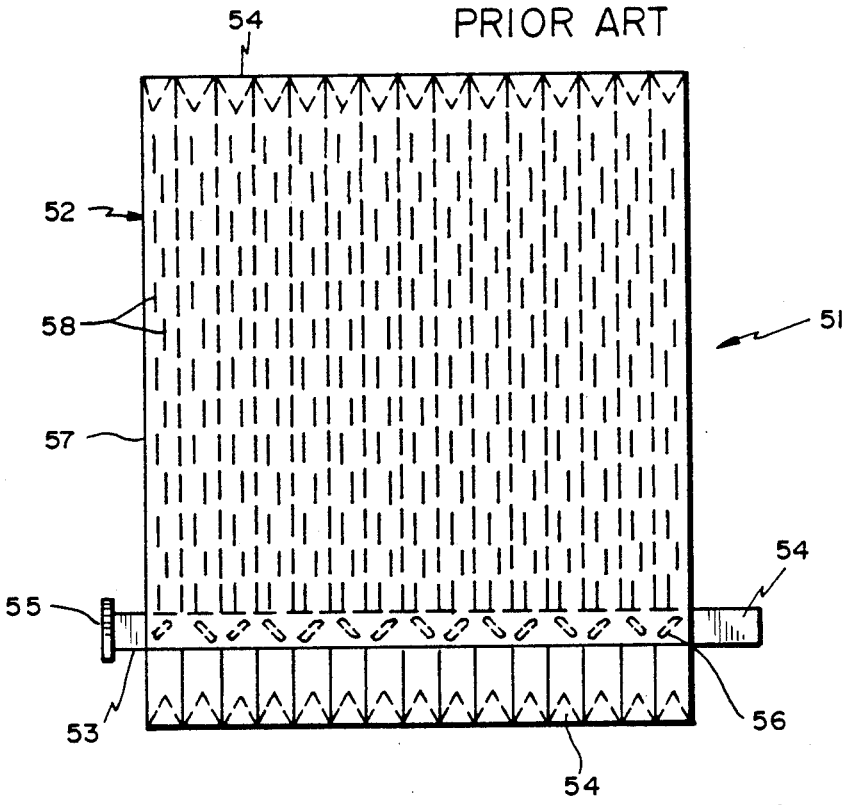
FIG. 6B
PRIOR ART
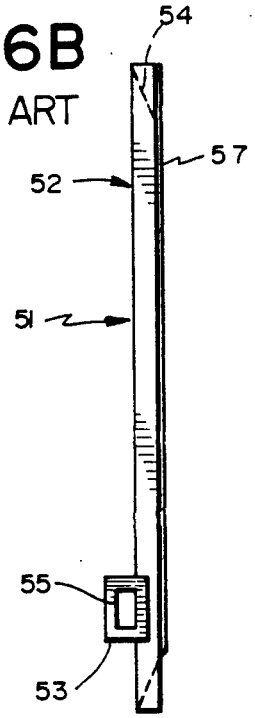
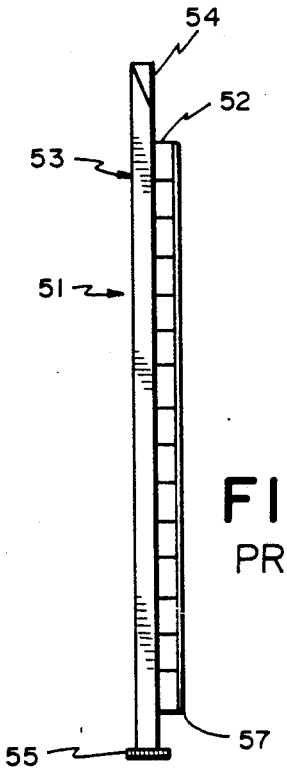
FIG. 6C
PRIOR ART

DISTRIBUTION NETWORK FOR PHASED ARRAY ANTENNAS

FIELD OF THE INVENTION

The invention relates to phased array antennas, and more specifically to the distribution of energy to antenna elements of extremely high frequency (EHF) phased arrays.

BACKGROUND OF THE INVENTION

Steerable phased array antennas usually require the transfer of array energy between a multiplicity of antenna elements, often several thousand in number, each of which has an associated phase shifter with a transmitter and/or a receiver. The conventional approach for distributing this energy has been a corporate-fed array.

FIG. 1 shows a corporate-fed array 20. A corporate feed or corporate distribution network 21 comprises a network of power dividers and series-parallel transmission lines and drives a plurality of electronics modules 22. These electronic modules 22 comprise pairs of phase shifters 23 and amplifiers 24. The electronic modules 22 drive an array of antenna elements 25, such as dipoles. When the phase shifters 23 in the electronic modules 22 are adjusted so that the antenna elements 25 are driven in a linear phase progression, the array of antenna elements produces equiphase fronts, which travel at an angle to the array. This results in a concentrated beam of energy in a direction perpendicular to the equiphase fronts. The direction of this concentrated beam can be changed in a predictable manner by changing the settings of individual phase shifters 23 to new predictable settings. In this manner, the array of antenna elements 25 can be used in conjunction with the electronics modules 22 to sweep a composite beam of radiated energy across a field of view.

The corporate-fed array 20 has several limitations including high transmission line losses at high frequencies and the need for attenuators or special couplers in series with the transmission lines to provide a tapered aperture distribution, that is, individual electronics modules 22 may need to be coupled to the corporate feed network 21 with different values of coupling so that a specified tapered amplitude distribution across the array is provided. Such amplitude distributions are required when low sidelobes are specified in resulting antenna patterns. These two limitations reduce efficiency of the array. Conventionally, several stages of amplification have been added to each electronics module 22 to compensate for these limitations. However, these added stages of amplification increase complexity, power requirements, phase and amplitude errors, and cost. The increased complexity also reduces reliability and, in the case of monolithic integrated circuits, reduces yield. Another approach for distributing array energy, which avoids the limitations of the corporate-fed array, is a space-fed array.

FIG. 2 shows a space-fed array 26. A simple feed horn 27 distributes energy to all antenna elements in an array by illuminating the back side of the array. Each antenna element 25 on the face of the array has a corresponding antenna element 28 that faces the feed horn 27 to receive this energy. Thus, in this approach, each electronics module 22 comprises two antenna elements 25 and 28, a phase shifter 23, and an amplifier 24.

The horn illumination pattern produced with this approach provides the varied coupling to the electronics modules 22 and, therefore, the tapered amplitude distribution across the aperture required for low sidelobes. Also, with this approach, transmission through free-space is much less lossy than through any other high frequency transmission line medium. Thus, fewer stages of amplification are required in each electronics module 22 for the space-fed array 26 than for the corporate-fed array 20. In addition, space-feeding randomizes phases of signals in the antenna elements 28 thereby reducing the probability of high quantization sidelobe levels in the antenna pattern, which are caused by digital phase shifting. Digital phase shifting is the most common phase shifting method embodied in phased array antennas. However, the principal disadvantage of a space-fed array 26 is the spatial distance between the feed horn 27 and the array and thus the resulting physical thickness of the array assembly. Typically, this spatial distance is equal to half the array diameter. This disadvantage has been eliminated by using a radial line distribution network, or flat plate-fed array.

FIG. 3 shows a flat plate-fed array 29. A flat plate-fed array 29 is essentially a special type of space-fed array in which feed-point spacing is reduced to about one-half wave-length and feed energy is guided radially outward between two flat plates 30 and 31 which act as a radial waveguide. See for instance, U.S. Pat. No. 3,576,579 to Appelbaum et al. As shown in FIG. 3*b*, taken from an embodiment of Appelbaum et al., a multimode launcher 32 generates a sum mode $\epsilon$, an azimuth difference mode $\Delta A$ and an elevation difference mode $\Delta E$ and feeds them into the radial power divider 33. This multimode launcher 32, which can also be used with space-fed arrays, provides an amplitude monopulse capability. Wave energy decreases in amplitude as distance increases from the feed-point. The radial power divider 33 comprises a multiplicity of directional couplers, distributed about concentric circles in the radial waveguide, which pick up that wave energy and transfer the energy to an array 34 of phase shifters and antenna elements. The directional couplers replace the pickup antenna elements 28 on the inside face of the space-fed array 26 of FIG. 2. Tapered amplitude distribution is achieved by adjusting coupling values in each concentric ring.

The flat plate-fed array 29 has several limitations. The array of antenna elements 25, fed by the flat plate, comprises concentric rings, so each ring of antenna elements requires a different coupler design. These different couplers must be indexed circumferentially, i.e., their physical configuration must be radially symmetric, to couple to a radially propagating wave. However, except in a circularly polarized array, the antenna elements 25 must all be aligned parallel, vertically, or horizontally, for instance. Ease of assembly, or electrical connections, for instance, may require a fixed orientation of antenna elements 25 even in a circular polarized array. As a result, there are no more than two antenna element modules with a common design in each ring of antenna elements 25. These couplers must be manufactured and assembled in the array extremely accurately for high microwave and millimeter wave frequency applications. Small tolerance errors perturb the required aperture distributions and may impose practical limits on achieving low sidelobe levels. Additionally, the cost of manufacturing EHF couplers, assembling them in an array, and performance verification testing is high.

FIG. 3c shows a section view of a modification of the FIG. 3b embodiment. A single ring of directional couplers 35 is used at the periphery of a circular radial waveguide. The energy from each directional coupler 35 is distributed to a set of antenna elements 25 through a stripline power divider (not shown) where power division values are tailored to match the required amplitude distribution of the array. This approach suffers from many of the same disadvantages as both the space-fed approach and the corporate feed approach.

FIG. 4 shows another radial waveguide 37 approach. Coaxial line pickup probes 38 replace directional couplers. Amplitude distribution is controlled by varying the spacing between the walls of the radial waveguide 37. Although this eliminates the need to index the pickup probes 38 circumferentially, mutual coupling between probes 38 is extremely sensitive to manufacturing and assembly tolerances, and is very frequency dependent. These factors impose a narrow frequency band limitation on this approach. Furthermore, coaxial lines, which would connect to the pickup probes 38, are lossy at EHF frequencies.

FIG. 5a shows a known distribution network 39 for a slotted waveguide array antenna. The antenna consists of a planar array of radiating slots 40 distributed along a coplanar wall 41 in each of an ensemble 42 of parallel waveguides. The distribution network 39 comprises a waveguide ensemble 42 fed or excited by an orthogonal excitation waveguide 43 or waveguides, through a row of inclined exciting slots 44 in a wall 45 common to the excitation waveguide 43 and the parallel waveguide ensemble 42, one slot per waveguide. A predetermined amplitude distribution is achieved in the plane parallel to the axis of the exciting waveguide 43 by adjusting the tilt angle of each inclined exciting slot 44, and in the orthogonal plane by adjusting the displacement of the radiating slots 40 from the center line of the waveguides as well as slot width and length. The waveguide can include a tapered waveguide load at the end of each waveguide.

FIG. 5b illustrates slot 40 and 44 configurations in a typical quadrant of a slotted waveguide array antenna having a circular aperture 46. FIG. 5c illustrates a millimeter wave, center-fed slotted waveguide array distribution network 47. This network 47 propagates radiation to each of four quadrants, similar to the quadrant of FIG. 5b. This distribution network 47 has monopulse capability. FIG. 5d shows a schematic diagram of a monopulse comparator network, which is used with a slotted, waveguide array distribution network. FIGS. 5b and 5c illustrate well known slot array antenna technology, and have been described in the "Microwave Journal" Magazine, July, 1985. FIGS. 5a and 5b have been described in the "Microwave Journal" Magazine, June, 1988.

FIG. 5e shows a rectangular waveguide 48 with the same dimensions as the waveguides of FIG. 5a having a rotated series slot 49 and a longitudinal shunt slot 50. This figure is used to illustrate how coupling values are computed in a slotted waveguide array distribution network. For example, FIG. 5f shows the parameters and equivalent circuit of a rotated series slot 49 while FIG. 5g shows the parameters and equivalent circuit of a longitudinal shunt slot 50. The ratio of input impedance to output impedance of the rotated series slot is a function of the angle of the slot 49 relative to the waveguide. The ratio of input conductance to output conductance of the longitudinal shunt slot 50 equals:

$$\frac{G}{G_o} = K \sin^2 \frac{\pi d}{a}$$

where K is a function of frequency and waveguide dimensions and is well known, "a" is height of the waveguide and "d" is a distance between the slot 50 and center of the height of the waveguide, known as center-line off-set. Such coupling slots in waveguides are well known, as are other slot configurations that could be used in such slotted waveguide array antennas and distribution networks.

Since no phase shifters, such as 23 of FIG. 1, are contained in a slotted waveguide array antenna, its radiation beam pattern has a fixed angular orientation. Beam scanning can only be achieved mechanically, that is, by physically reorienting the antenna, or by changing frequency. Mechanical scanning is slow compared to scanning achieved by electronically adjusting phase shifters and requires more space to implement. A consequence of the latter is that such antennas cannot both scan and remain conformal to a surface, such as the skin of an aircraft. Slotted waveguide array antennas can also scan their beam pattern by changing frequency, but this method is incompatible with their use in communication systems and is frequently undesireable in other applications such as radar.

BRIEF DESCRIPTION OF THE FIGURES

FIG. 6a–6c illustrate an end-fed slotted waveguide array antenna according to this invention.

FIG. 11b shows a circuit which is an equivalent to the slot of FIG. 11a.

SUMMARY OF THE INVENTION

Figure 1:
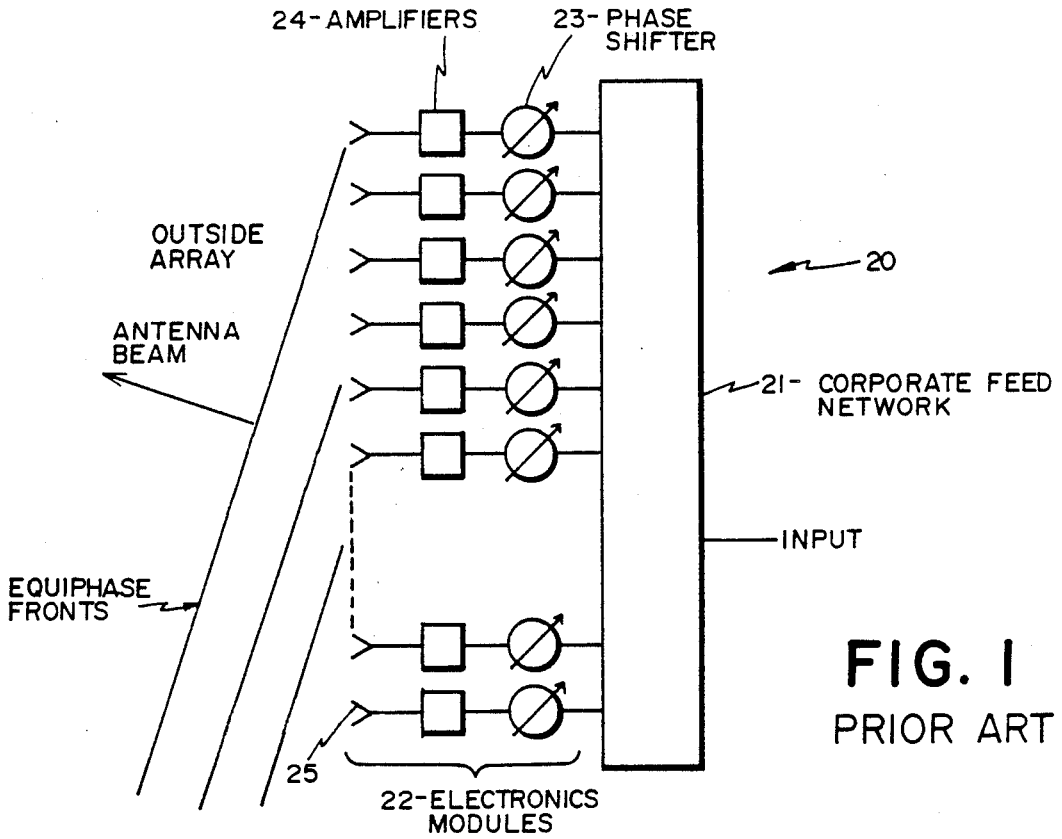
FIG. 1 PRIOR ART
FIG. 1 shows a prior art corporate-fed array.
Figure 2:
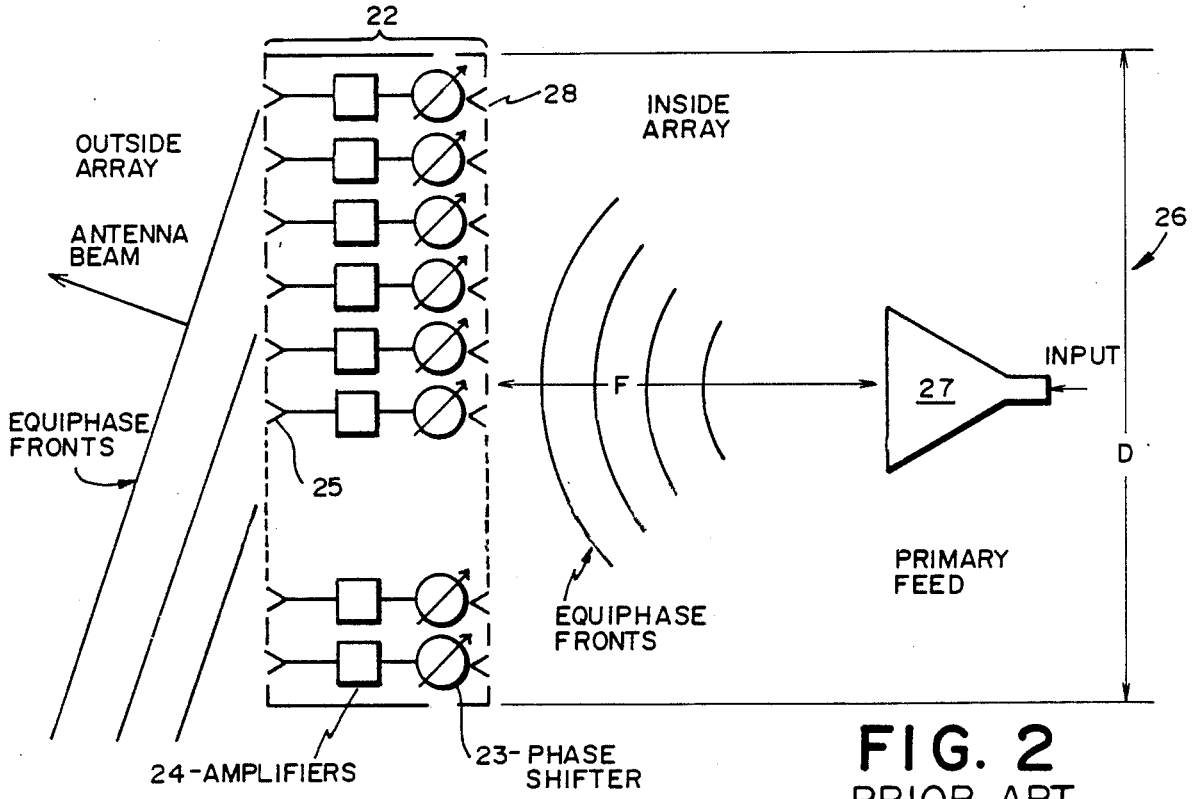
FIG. 2 PRIOR ART
FIG. 2 shows a prior art space-fed array.
Figure 3A:
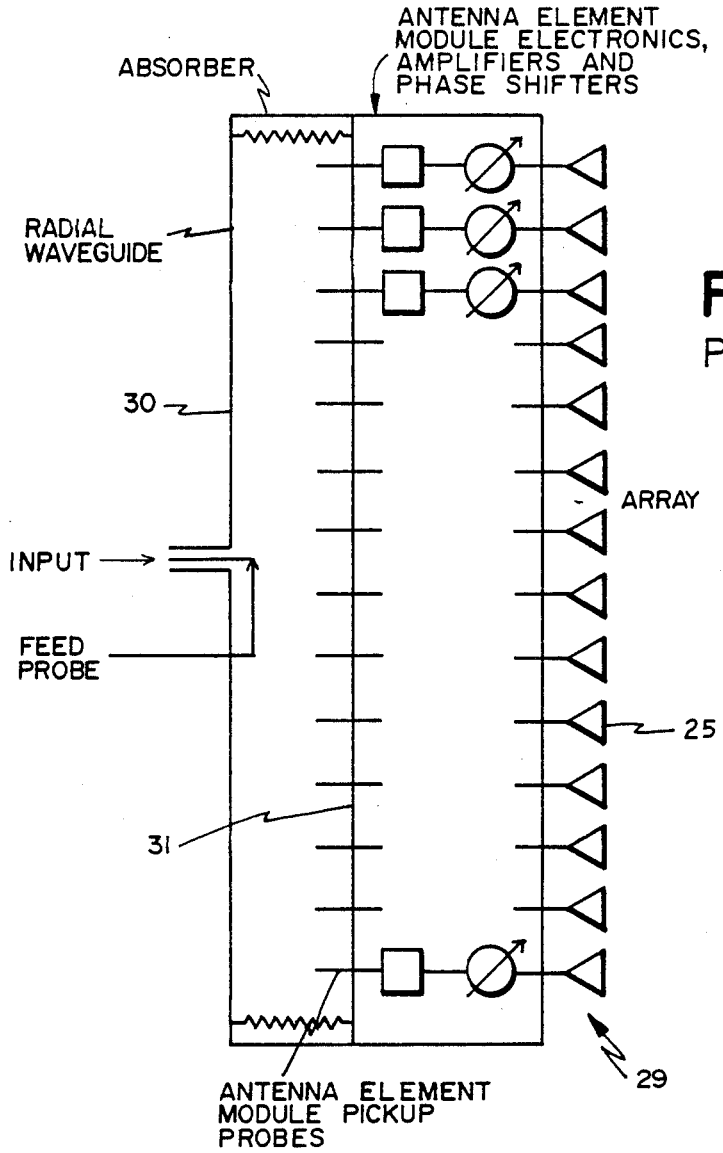
FIG. 3A PRIOR ART
FIG. 3a shows a prior art flat plate-fed array.
Figure 3B:
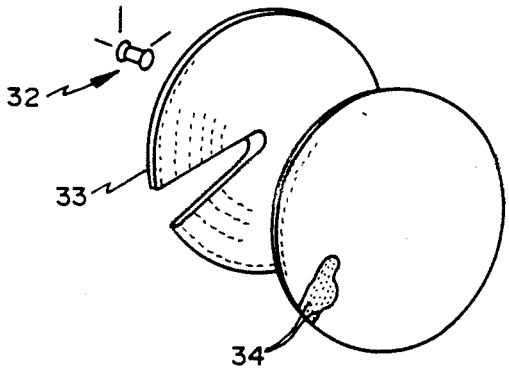
FIG. 3B PRIOR ART
FIG. 3b shows a specific prior art embodiment of a flat plate-fed array.
Figure 3C:
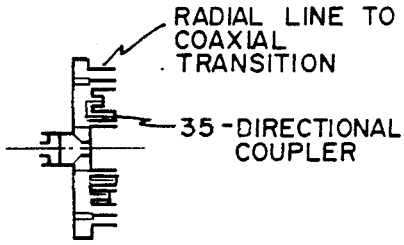
FIG. 3C PRIOR ART
FIG. 3c shows a sectional view of a modification to the array of FIG. 3b.
Figure 4:
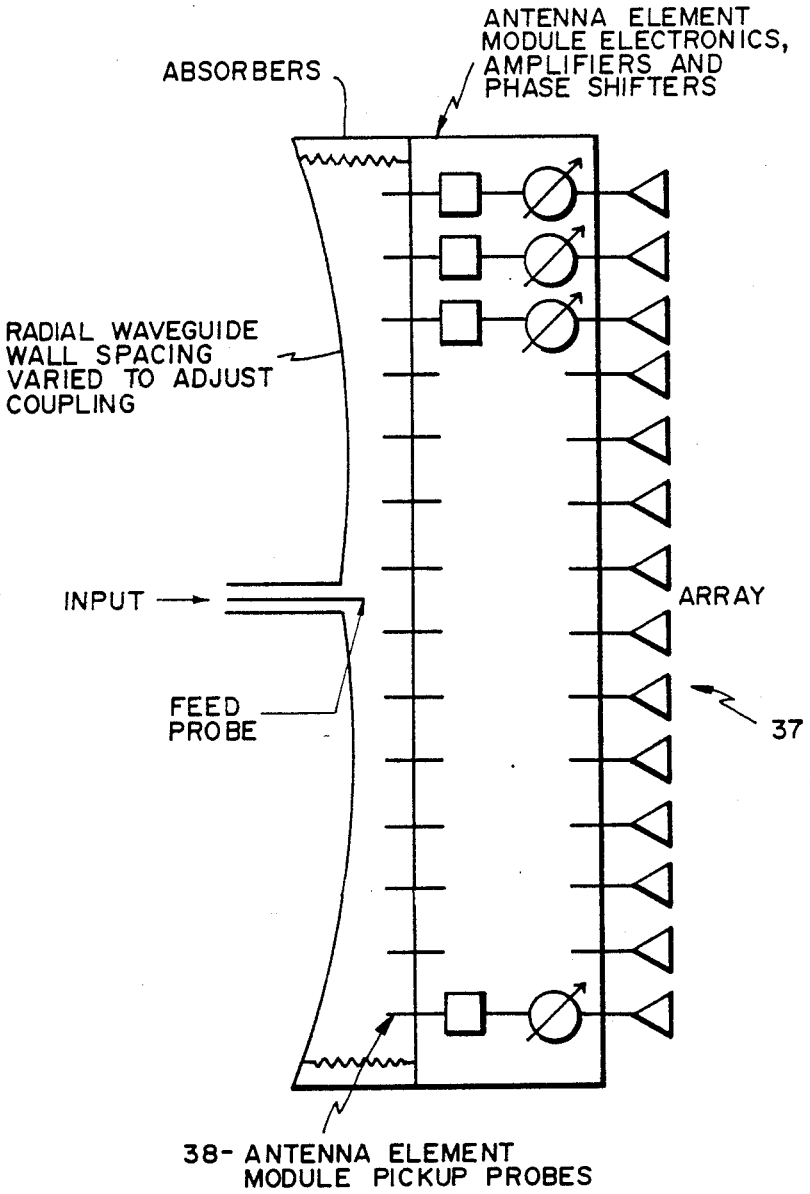
FIG. 4 PRIOR ART
FIG. 4 illustrates a prior art radial line approach to a flat plate fed array.
Figure 5A:
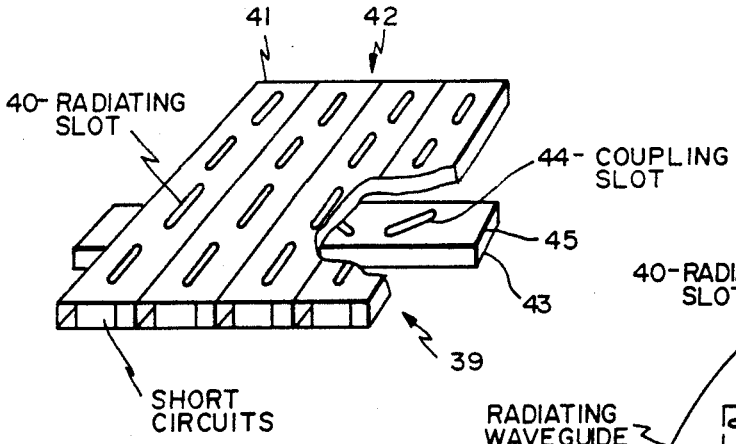
FIG. 5A PRIOR ART
FIGS. 5a–5d illustrate a prior art distribution network for a center-fed slotted waveguide array antenna.
Figure 5B:
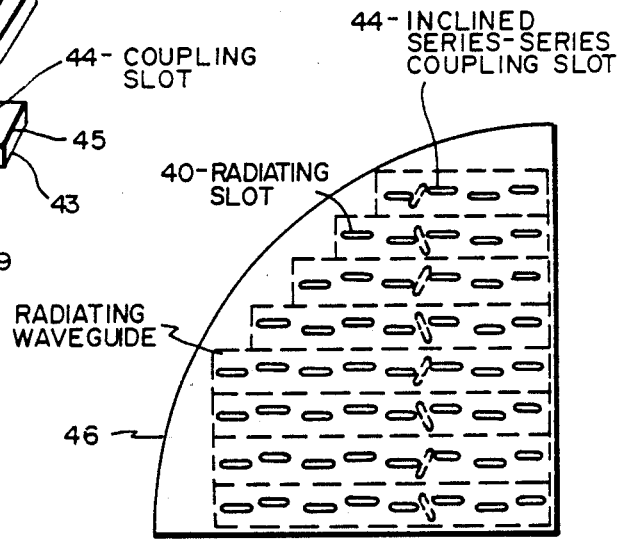
FIG. 5B PRIOR ART
Figure 5C:
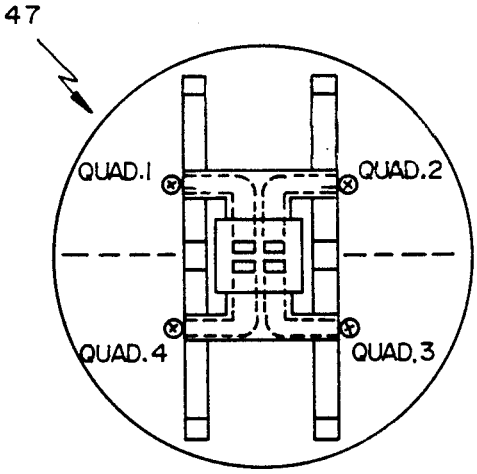
FIG. 5C PRIOR ART
Figure 5D:
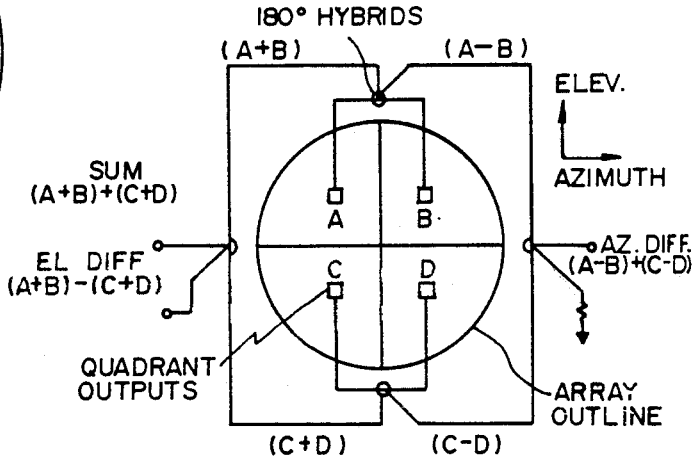
FIG. 5D PRIOR ART
Figure 5E:
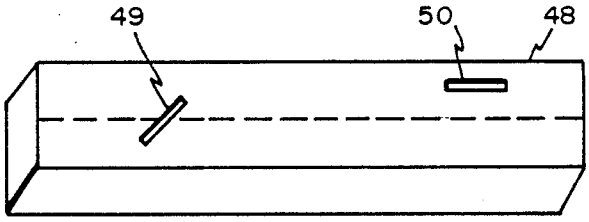
FIG. 5E PRIOR ART
FIG. 5e shows a rectangular waveguide having a rotated series slot and a longitudinal shunt slot used to illustrate parameters for calculating slot coupling values in rectangular waveguides according to FIGS. 5f and 5g.
Figure 5F:
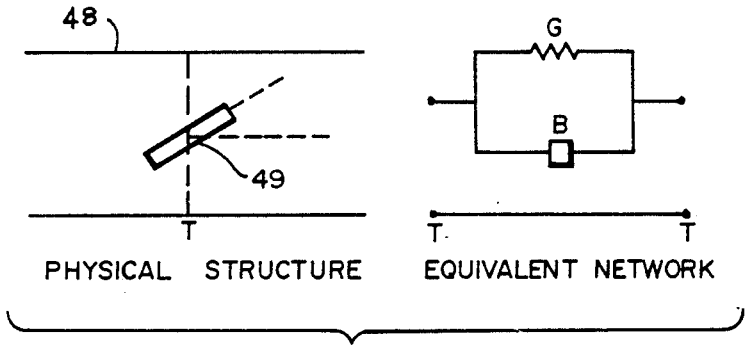
FIG. 5F PRIOR ART
Figure 5G:
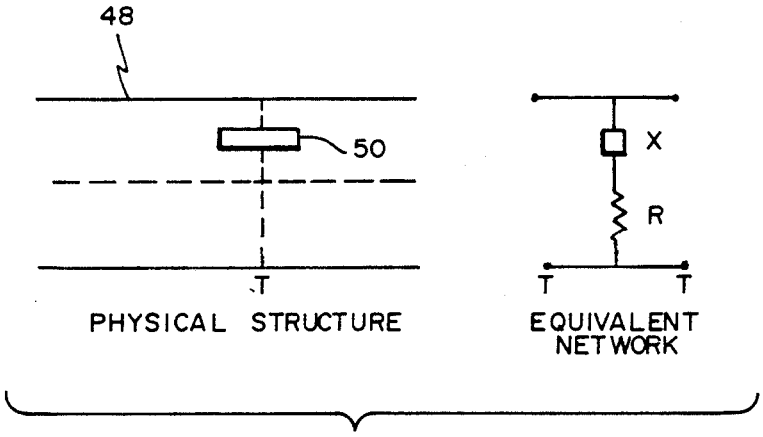
FIG. 5G PRIOR ART

The invention concerns a phased array antenna comprising a means for distributing energy to antenna elements of the array, comprising at least one waveguide having an array of radiating slots, and a means for exciting the means for distributing energy comprising an orthogonal waveguide having a row of slots adjacent the radiating slots.

DESCRIPTION OF THE INVENTION

According to this invention, an array of slots is used to feed waveguide energy to the inside face of a quasi-space-fed antenna array. A preferred, though not exclusive, embodiment comprises an antenna array wherein electronics modules are in the form of identical, individual replaceable pellets capable of economical large-quantity production.

According to this invention, each slot feeds one electronics module comprising a replaceable pellet in an array. Antenna elements in the array, and therefore the electronics modules, are preferrably distributed in a regular pattern which is either rectangular with a spacing between element centers of approximately 0.5 wavelength, or triangular with a spacing between element centers of approximately 0.58 wavelengths. However, slots in the distribution network are not necessarily regularly spaced, since the center-line off-set of the slots of each waveguide can be used to generate a specified amplitude taper, as discussed concerning FIGS. 9 and 10.

FIG. 6*a* shows a front view of a distribution network 51 for a slotted waveguide array antenna according to this invention. Here an ensemble 52 of waveguides is fed from one end by an excitation waveguide 53. Both ends of the waveguides of the ensemble 52 are terminated in waveguide loads 54, as is the output end of the excitation waveguide 53. These loads 54 are used to absorb residual energy and to prevent build-up of frequency-sensitive standing waves in the waveguides of the ensemble 52. To the inventors' knowledge, this end fed slotted waveguide array antenna comprising the distribution network 51 has not been previously described.

The excitation waveguide 53 includes an excitation waveguide flange 55 and the waveguide load 54. The excitation waveguide 53 propagates radiation through slots 56 in the excitation waveguide 53 to the ensemble 52 of parallel waveguides. Each of the ensemble 52 of parallel waveguides comprises a waveguide having slots 58 that comprise radiating parallel shunt slots. Radiation then propagates through the slots 58 of each of the ensemble 52 of parallel waveguides and passes through a thin cover plate 57. This cover plate 57 forms a composite interface wall for all the waveguides in the ensemble 52 and has radiation slots also, which couple radiation to each electronic module in the phased array. The radiating slots of the cover plate 57 are adjacent each electronics module of the array. An energy receptor at the face of each electronics module receives the radiation from the radiating slots of the thin cover plate.

FIG. 6*b* shows a side view of the distribution network 51 of FIG. 6*a*. FIG. 6*c* shows a view of an adjacent side of the distribution network 51 of FIG. 6*a*.

Figure 7:
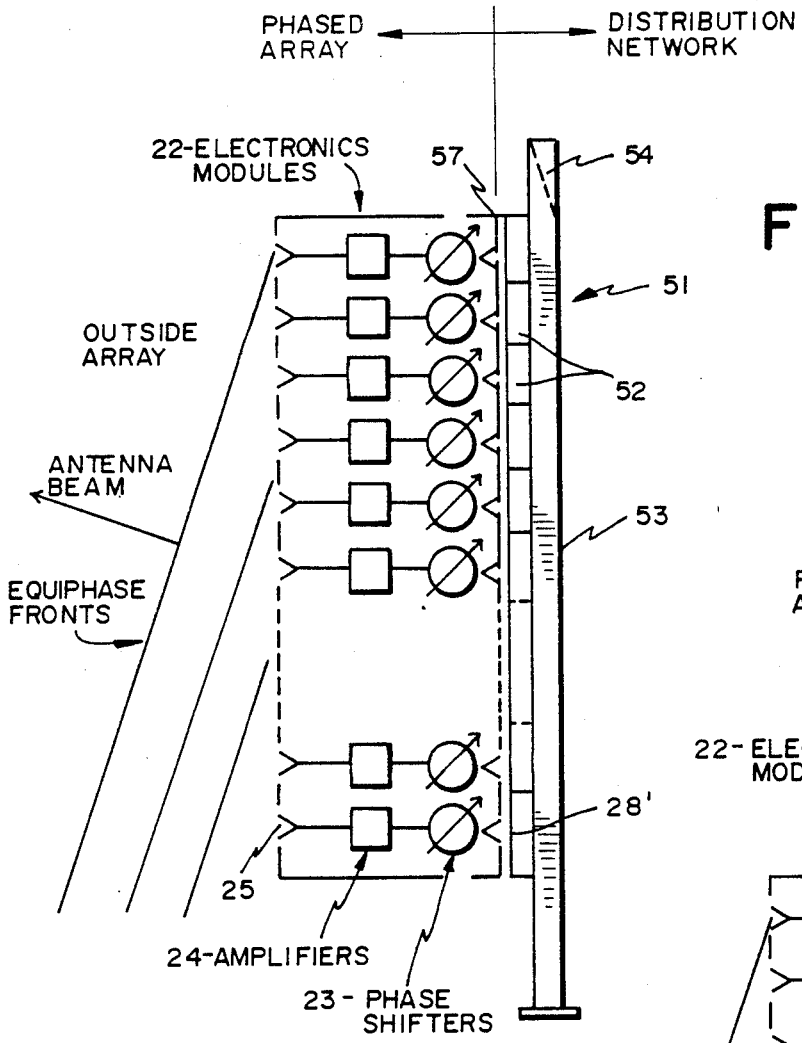
FIG. 7 schematically shows a side view of the present invention.

FIG. 7 shows a schematic diagram of a side view of the invention. The invention comprises an end-fed slotted waveguide array distribution network 51 as shown in FIGS. 6*a*–6*c* integrated with a phased array antenna which consists of a planar array of a plurality of electronics modules 22. The slotted waveguide array distribution network 51 parallels the planar array of electronic modules 22. The array of electronics modules 22, comprising phase shifters 23, amplifiers 24, antenna elements 25, and energy receptors 28', generates equiphase fronts of radiation. According to this invention, however, the array of electronics modules 22 is fed by the slotted waveguide array distribution network 51 of FIG. 6, for instance. Radiation exits the ensemble of parallel waveguides through the radiating slots, which are adjacent each electronics module of the array. An energy receptor 28' at the face of each electronics module receives the radiation from the radiating slots of the thin cover plate. Energy receptors 28' can be slots, open ended waveguides, small antennas or other of a variety of devices known to practitioners in the field of antennas. Each electronics module can comprise a replaceable pellet as mentioned above.

Figure 8:
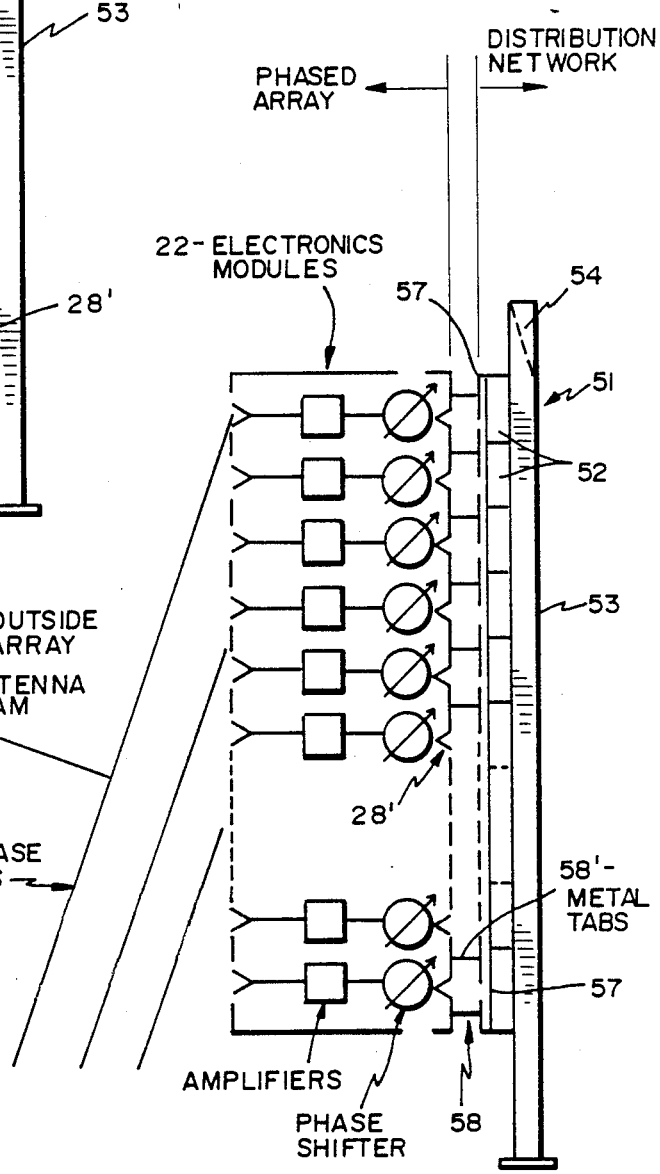
FIG. 8 schematically shows a modification of the device of FIG. 7.

FIG. 8 shows another embodiment of the end-fed slotted waveguide array of this invention. In this embodiment, air or a dielectric 58 is included between the distribution network 51 and the phased array. The distribution network 51 of FIGS. 7 and 8 comprises the excitation waveguide 53, the ensemble of parallel waveguides 52, and the thin cover plate 57 having radiating slots. The phased array comprises the array of electronics modules 22. A predictable composite radiation field is thereby established at the output of the waveguide distribution network. The energy receptors, such as antenna elements 28', at the face of each electronics module 22 in the phased array couple electromagnetically to that radiation field rather than to radiation from a specific slot of the cover plate 57 as in FIG. 7. Metal tabs 58, having minimum effect on that composite radiation field because of their size and geometry, may be used to connect the waveguide distribution network to the phased array. These tabs 58 maintain required spacing tolerances between the two assemblies and conduct heat away from the active modules of the phased array.

Figure 9:
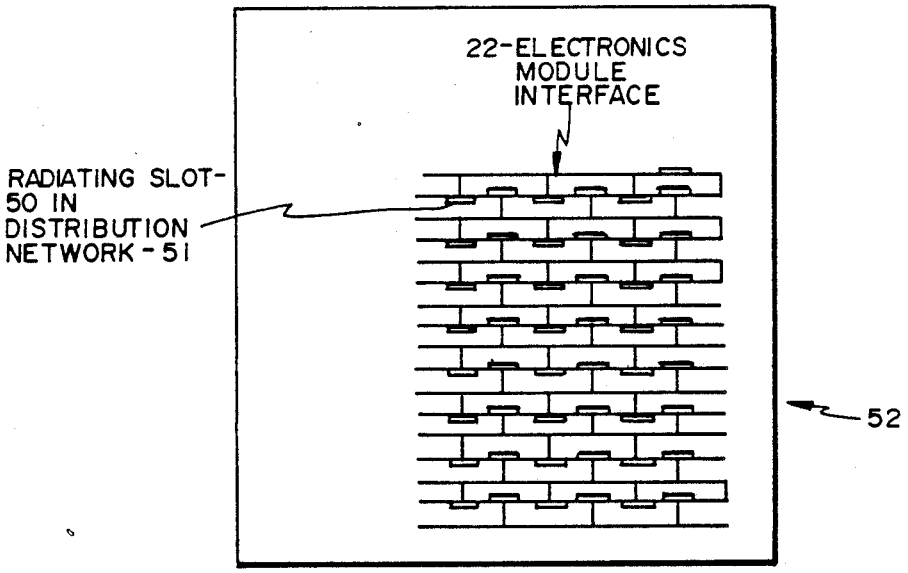
FIG. 9 shows a triangular array of electronics modules interfacing with a distribution network.

FIG. 9 illustrates that the invention accomodates differences in slot spacing and the interface between the triangular array of electronics modules 22 and a distribution network 51. The distribution network interface consists of the radiating parallel shunt slots 50 in the ensemble 52 of parallel waveguides. In this embodiment, each electronics module interface comprises a dielectric loaded waveguide. The slot 50 presents a shunt capacitance at the electronics module 22 input. Suseptance depends upon the slot width, length, and position relative to the electronics module interface and center-line off-set in the distribution network waveguide.

Figure 10:
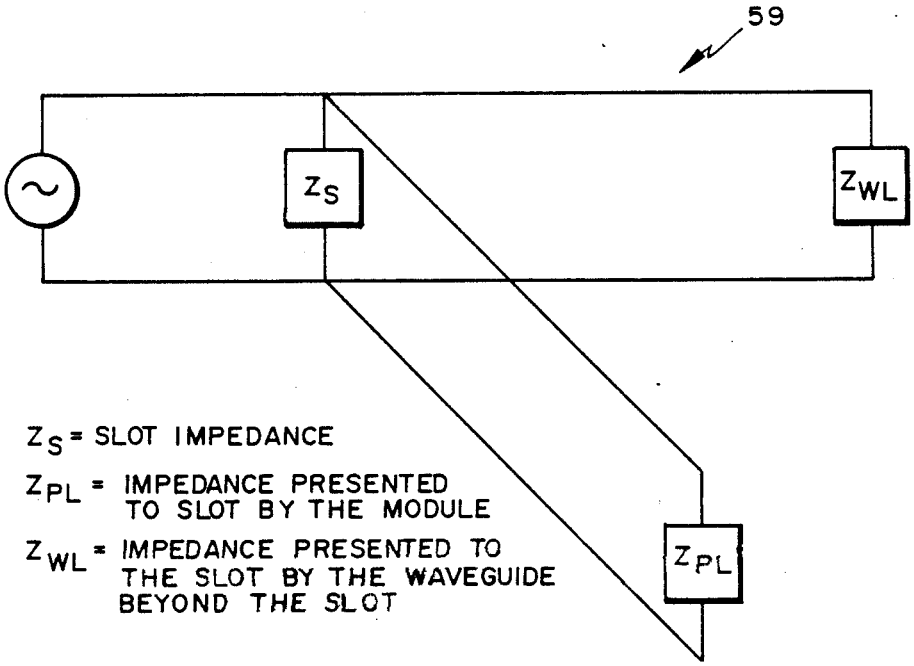
FIG. 10 illustrates a circuit model for calculating slot parameters.

FIG. 10 shows an equivalent circuit model 59 which represents one approach that can be used to calculate slot parameters required to satisfy a specified amplitude distribution in the array. The methods of moments or boundary-value problems are examples of methods that can be used to determine equivalent circuit parameters of the junction of the slot and space-fed array of this invention. $Z_s$ is slot impedance, $Z_{pl}$ is impedance presented to the slot by a replaceable pellet, and $Z_{wl}$ is the impedance presented to the slot by the waveguide beyond the slot.

The inventors have made a generalized calculation to assure feasibility of their invention. Variation in slot reactance has been considered a function of slot location and geometry and the slot has been considered approximately equivalent to a window in a matched waveguide as discussed concerning FIGS. 11*a–c*, for instance.

Figure 11A:
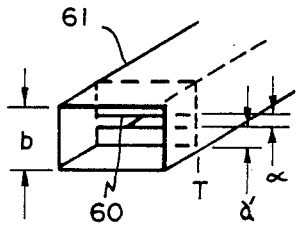
FIG. 11a shows an isometric view of a slot modeled as a window in a rectangular wave guide.
Figure 11B:
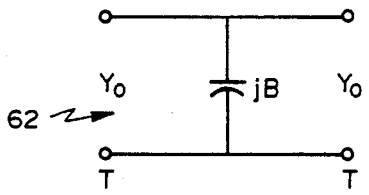
Figure 11C:
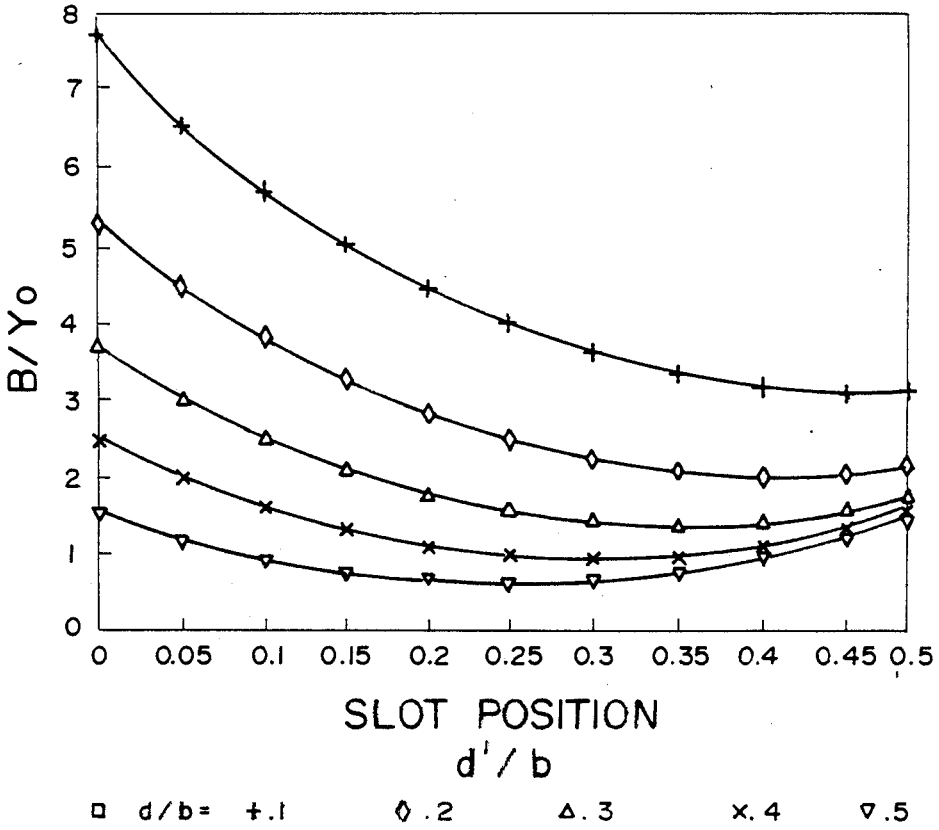
FIG. 11c illustrates the variation in slot suseptance as a function of slot width and location.

FIG. 11*a* shows an isometric view of a slot 60 modeled as a window in a rectangular wave guide 61. FIG. 11*b* shows a circuit 62 which is an equivalent to the slot 60 at position $\tau$ of FIG. 11*a*. FIG. 11*c* illustrates, for a typical set of parameters, the calculated variation in slot suseptance B/Yo normalized to the characteristic impedance of an electronics module comprising a pellet, as a function of slot width and location. The slot width has been set to the full internal dimension of the waveguide containing the pellet for the curves of FIG. 11*c*, in which case the slot 60 presents a shunt capacitance to the pellet.

Figure 12:
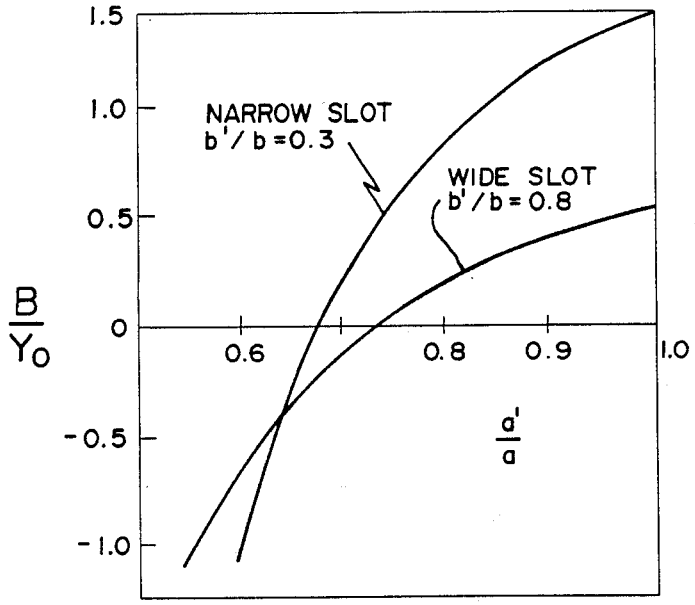
FIG. 12 illustrates normalized suseptance as a function of slot length.

FIG. 12 shows a variation of normalized suseptance as a function of slot length for two choices of slot width where the slot is positioned in the center of the pellet opening. This indicates that under certain conditions the slot can be made resonant by adjusting the length of the slot, thereby providing a slot inductance. An appropriate value of impedance can be presented to each module by selective choice of the slot width, length, and position, and while also establishing an appropriate radio frequency (RF) power taper across the array for control of the final antenna pattern. According to this invention, an identical matching network can be provided in each electronics module, and can be of identical design. This feature of the invention permits mass production of the electronics modules and testing to a single set of specifications.

For purposes of explanation, rotated series slots 49 and longitudinal shunt slots 50, both in the broad wall of rectangular waveguides have been used in the descriptions. It is readily recognized by those skilled in the art that other slot configurations are possible. For instance, the ensemble of waveguides could be arranged so that broad walls are shared. Then radiating slots would be in the narrow wall of each waveguide in the ensemble as would be coupling slots to the excitation waveguide. Also coupling means between the excitation waveguide and the waveguides in the ensemble can be other than slots, for instance, magnetic field coupling loops or electric field coupling probes, examples of which are shown in FIGS. 13*a* and 13*b*, respectively.

Figure 13A:
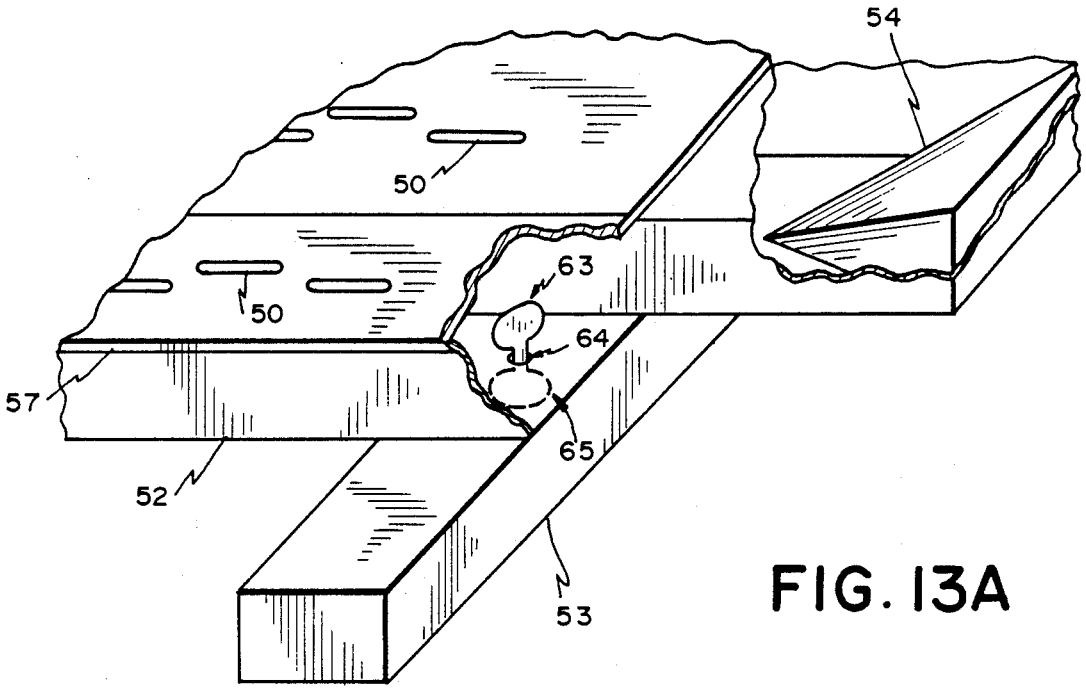
FIG. 13a shows an alternate embodiment of coupling between waveguides of the invention using magnetic loops.
Figure 13B:
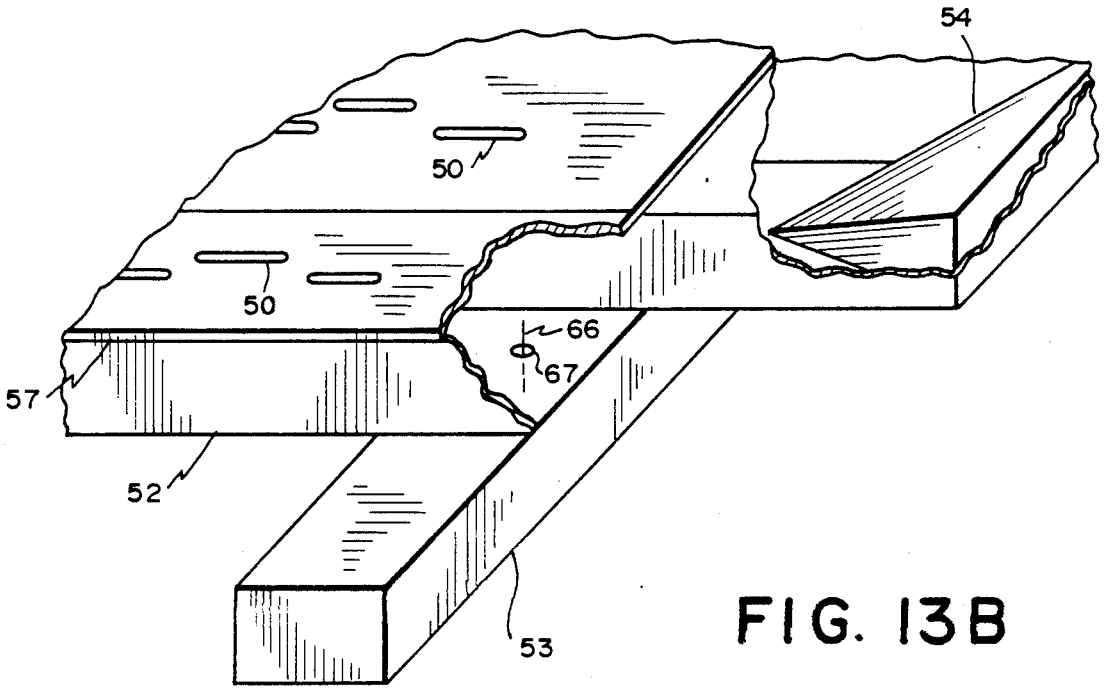
FIG. 13*b* shows an alternate embodiment of coupling between waveguides of the invention using electric field probes.

FIG. 13*a* shows a coupling loop 63 inside and perpendicular to the longitudinal axis of a representative waveguide in the ensemble 52 of waveguides. The coupling loop 63 extends through a feed hole 64 and forms another coupling loop 65 inside and perpendicular to the longitudinal axis of the excitation waveguide 53. FIG. 13*b* shows a coupling probe 66 extending from a representative waveguide in the ensemble 52 of waveguides, through a feed hole 67 and into the excitation waveguide 53.

Figures 14A, 14B:
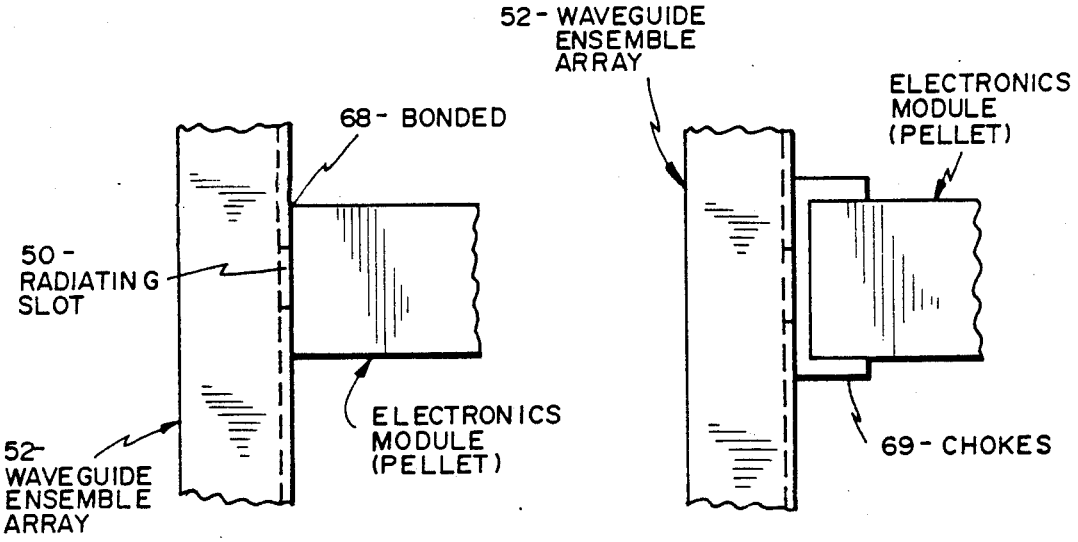
FIGS. 14*a* and 14*b* show two examples of electromagnetic coupling between the distribution network and electronics modules of the phased array.

FIGS. 14*a* and 14*b* show two examples of electromagnetic coupling between the distribution network 51 and electronics modules 22 of the phased array. FIG. 14*a* shows the distribution network 51 conductively bonded to a typical electronics module 22 of the array. The distribution network 51 is conductively bonded at 68 by brazing, welding, soldering, or adhesive for instance. FIG. 14*b* shows the distribution network 51 reactively coupled to a typical electronics module 22 of the array with choke joints 69. Other methods of integrating the slotted waveguide distribution network of FIGS. 7 and 8 with the plurality of electronics modules 22 comprising the phased array will be apparent to those skilled in the art.

This invention provides a distribution of energy to each of the antenna elements in a phased array using an ensemble of slotted waveguides. This invention has many advantages over other devices.

The distribution network of this invention is approximately as efficient as a space-fed array. Waveguides used in the invention are a low-loss transmission medium and amplitude distribution is accomplished without the need for attenuators. The slots of the waveguides couple virtually all the power from an excitation waveguide to the electronics modules in the array. Each waveguide can terminate in a resistive load to absorb any residual power and thereby prevent standing waves in the network. The power lost here is small, particularly for large arrays. Because the distribution network is efficient, the array is efficient and, thus, each electronics module requires a minimum number of stages of amplification, which minimizes phase and amplitude errors in the array.

The distribution network and array of this invention are as compact as a corporate feed array. The waveguide distribution network of this invention only adds about one-half wavelength to the thickness of the array and can act to conduct heat away from the modules or as a cooling plenum.

The distribution of energy does not require physical contact between the distribution network and the phased array. Instead, electromagnetic coupling is used which simplifies array assembly and reduces phase and amplitude errors in the array.

The distribution network of this invention is accurate. The ensemble of slots in the distribution network can be designed to provide virtually any specified amplitude distribution across the antenna array in two planes and can be manufactured with precision using either machining or photo-etching techniques. The waveguides constituting the distribution network can be assembled very accurately using such manufacturing techniques as electroforming, electric discharge machining, precision machining and assembly, for instance. Slotted array antennas that operate at frequencies as high as 60 GHz are known. All electronic modules in the array have a common design, and can be mass produced, tested separately and then sorted before assembly to assure uniform characteristics.

The array of this invention is tolerant of phase error. Slot positions along the axes of the distribution network waveguides can be designed to interface with the individual modules regardless of relative phase. Then, as with space-fed arrays, the phase shifter settings may be used to cancel known phase differences. Quantization errors are pseudorandom, which minimizes quantization sidelobes.

This invention can be used with a phased arrays having identical, replaceable, individual electronics modules capable of economical mass production.

It can be recognized by those skilled in the antenna art that because antennas are reciprocal, the invention applies to both transmitting and receiving phased array antennas.

We claim:

1. A phased array antenna, comprising:

a planar array of electronic antenna elements;

a means for distributing energy to the antenna elements of the planar array, comprising at least one waveguide parallel to the planar array and having an array of radiating slots; and a means for exciting the means for distributing energy, comprising an orthogonal waveguide having a row of slots adjacent to the radiating slots.

2. The antenna of claim 1, the at least one waveguide comprising an ensemble of parallel waveguides.

3. The antenna of claim 2, wherein the row of slots of the orthogonal waveguide are inclined relative to the radiating slots.

4. The antenna of claim 3, the means for distributing energy comprising an excitation waveguide for feeding radiation to one end of the ensemble of parallel waveguides.

5. The antenna of claim 4, comprising a means for coupling the excitation waveguide to the ensemble of parallel waveguides.

6. The antenna of claim 5, each of the antenna elements of the planar array having a means for receiving radiation from the radiating slots of the ensemble of parallel waveguides.

7. The antenna of claim 6, each antenna element of the planar array having a radiation receptor adjacent a corresponding radiating slot of the ensemble of parallel waveguides.

8. The antenna of claim 7, each antenna element comprising an electronics module bonded to the ensemble of parallel waveguides.

9. The antenna of claim 8, each antenna element comprises an electronics module joined to the ensemble of parallel waveguides by a choke joint.

10. The antenna of claim 9, the means for coupling comprising a coupling probe.

11. The antenna of claim 9, the means for coupling comprising a coupling loop.

12. A phased array antenna comprising:

a planar array of electronic antenna elements, each antenna element having a means for receiving radiation; and a means for distributing radiation energy to each means for receiving radiation, the means for distributing radiation comprising a slotted waveguide parallel to the planar array of antenna elements.

* * * * *

UNITED STATES PATENT AND TRADEMARK OFFICE

CERTIFICATE OF CORRECTION

PATENT NO. : 4,939,527

DATED : July 3, 1990

INVENTOR(S) : Bernard J. Lamberty et al.

It is certified that error appears in the above-identified patent and that said Letters Patent is hereby corrected as shown below:

In Figures 6A, 6B, and 6C, the words

"PRIOR ART" are deleted.

Signed and Sealed this

Nineteenth Day of May, 1992

*Attest:*

DOUGLAS B. COMER

*Attesting Officer*

*Acting Commissioner of Patents and Trademarks*